US006029681A

United States Patent [19]

Gaydoul et al.

[11] Patent Number: 6,029,681

[45] Date of Patent: Feb. 29, 2000

[54] DEVICE FOR DE-SCALING SEMI-FINISHED PRODUCTS

[75] Inventors: Jürgen Gaydoul, Täby, Sweden; Wolfgang Gieseler, Walkenried, Germany

[73] Assignee: Hermetic Hydraulik AB, Täby, Sweden

[21] Appl. No.: 09/043,495

[22] PCT Filed: Sep. 20, 1996

[86] PCT No.: PCT/EP96/04126

§ 371 Date: May 20, 1998

§ 102(e) Date: May 20, 1998

[87] PCT Pub. No.: WO97/11797

PCT Pub. Date: Apr. 3, 1997

[30] Foreign Application Priority Data

Sep. 26, 1995 [DE] Germany ..... 195 35 789

[51] Int. Cl.[7] ..... B08B 3/02

[52] U.S. Cl. ..... 134/56 R; 134/57 R; 134/122 R; 134/181; 134/198; 239/263.1; 239/264

[58] Field of Search ..... 134/122 R, 56 R, 134/64 R, 172, 181, 198, 199, 57 R; 239/263.1, 264, 753, 751

[56] References Cited

U.S. PATENT DOCUMENTS

| | | | |
|---|---|---|---|
| 3,722,278 | 3/1973 | Young | 73/228 |
| 3,811,305 | 5/1974 | Saylor | 72/39 |
| 4,070,884 | 1/1978 | Grube | 72/39 |
| 4,205,694 | 6/1980 | Thompson | 134/181 |
| 4,251,956 | 2/1981 | Hirata | 51/428 |
| 4,269,052 | 5/1981 | Imai | 72/39 |
| 4,394,786 | 7/1983 | Stalson | 15/306 |
| 4,779,423 | 10/1988 | Szezupak | 60/602 |
| 4,905,913 | 3/1990 | Frikker . | |
| 5,266,115 | 11/1993 | Taccon et al. . | |
| 5,358,568 | 10/1994 | Okano | 118/323 |
| 5,502,881 | 4/1996 | Gaydoul | 29/81.08 |
| 5,558,110 | 9/1996 | Willford et al. . | |
| 5,613,509 | 3/1997 | Klob et al. . | |

FOREIGN PATENT DOCUMENTS

| | | |
|---|---|---|
| 0360480 | 3/1990 | European Pat. Off. . |
| 1938147 | 2/1970 | Germany . |
| 2922701 | 12/1979 | Germany . |
| 3019542 | 12/1981 | Germany . |
| 4328303 | 6/1994 | Germany . |
| 57-32820 | 2/1982 | Japan . |
| 4-46625 | 2/1992 | Japan . |
| 5-228526 | 9/1993 | Japan . |

*Primary Examiner*—Frankie L. Stinson
*Attorney, Agent, or Firm*—John C. Thompson

[57] ABSTRACT

An apparatus for descaling semi-finished products, such as thin slabs or steel strips in rolling mills by highly pressurized water that is sprayed through a nozzle device onto the surface of the semi-finished product is characterized in that the nozzle device is movable with a vertical component above the surface of the semi-finished product by means of a drive. The drive can be controlled by a control device that receives a target distance as input value and an actual distance between the nozzle device and the surface of the semi-finished product detected by means of a distance sensor. The control device supplies an output signal via a signal line to the drive for resetting any deviation to zero. Hence, the nozzle device is always kept at a desired target distance even if humps such as bulgings occur on the surface of the semi-finished product.

4 Claims, 1 Drawing Sheet

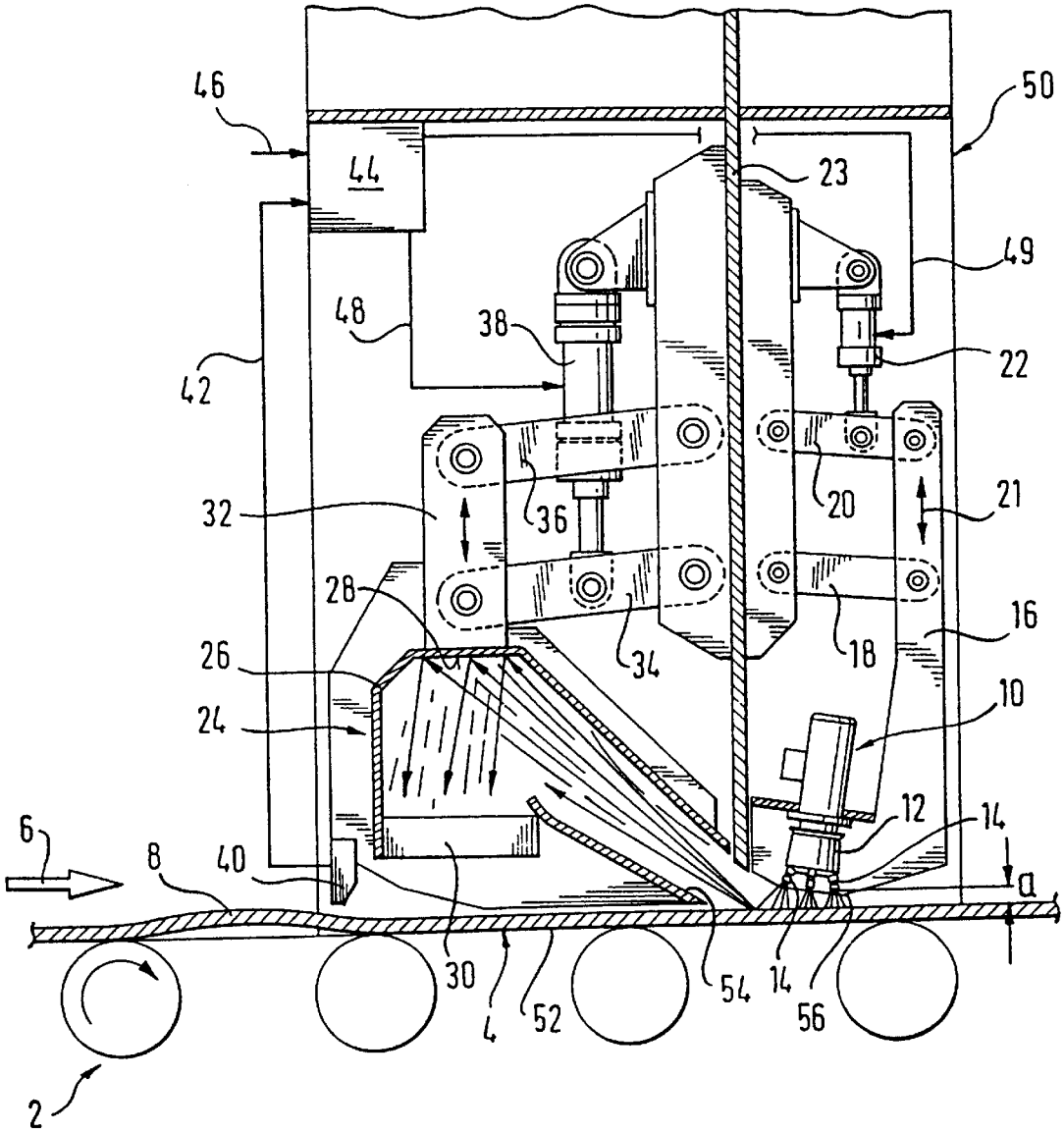
46
50
44
23
49
48
38
22
42
32
36
20
21
28
16
26
34
18
24
10
12
14
6
8
40
a
30
54
14
56
4
52
2

DEVICE FOR DE-SCALING SEMI-FINISHED PRODUCTS

CROSS-REFERENCE TO RELATED APPLICATIONS

This application is a national filing of Patent Cooperation Treaty application No. PCT/EP96/04126, which in turn claims priority from German 195 35 789.2 filed Sep. 26, 1995.

TECHNICAL FIELD

The invention relates to an apparatus for descaling semi-finished products, in particular thin slabs of steel strips in rolling mills, by means of highly pressurized water that is sprayed through a nozzle device onto the surface of the semi-finished product which is moved in relation to the nozzle device, wherein the nozzle device is arranged for movement by a drive under the control of a control device having a sensor adapted to determine the distance of the nozzle device from the surface of the product, said movement having a vertical component with regard to the surface. More particularly, this invention relates to such an apparatus wherein a plurality of nozzle devices are attached to a bar which is mounted to a fixed carrier by means of a four bar linkage means which is pivotable by the drive, and in that the control device is provided for actuating the drive in response to an output signal of the sensor, which is designed as a displacement transducer, for keeping constant the distance of the nozzle device from the surface of the semifinished product.

BACKGROUND OF THE INVENTION

In a known apparatus of this kind (JP-A-52 2 8 526) the upper portion of a nozzle device is controlled in response to signals of a thickness sensor by means of a vertical lifting device for compensating thickness variations of the products so as to keep constant the distance between the nozzle openings of the upper nozzle device and the surface of the semifinished product. When hot-rolling slabs and steel strips, the forging scales have to be removed before performing the rolling process to obtain a good surface. It is known to carry out such a descaling process by means of spraying highly pressurized water at pressures of about 1000 bar onto the surface to be descaled. A known descaling apparatus for descaling by means of highly pressurized water is described in U.S. Pat. No. 5,502,881. In the nozzle device described in this patent, a plurality of rotating nozzle heads each having four nozzles distributed around the outer circumference thereof for spraying the highly pressurized water, are attached to a girder fixedly mounted and disposed transversely to the moving direction of the strip conveyed underneath and at such a distance that bulgings and unevenness of the strip conveyed past the nozzle device do not lead to a collision. This distance is relatively large in the known apparatus. This leads to a reduction of the spray pressure of the highly pressurized water at the workpiece. A sufficiently high spraying pressure can only be achieved by increasing the water pressure or the amount of water, which results in a great power consumption. A reduction of the distance of the nozzle device to the strip surface is not possible because of the above described risk of a collision.

OBJECTS AND SUMMARY OF THE INVENTION

The object of the invention is to provide an apparatus of the above mentioned kind which permits a reduction of the distance between the surface of the steel strip and the nozzle device.

This object is achieved by attaching a plurality of nozzle devices to a bar which is mounted at a fixed carrier by means of a four bar linkage means, which is pivotable by a drive, and in that a control device is provided for actuating the drive in response to an output signal of a sensor, which is designed as a displacement transducer, for keeping constant the distance of the nozzle device from the surface of the semifinished product.

In the apparatus of the invention, owing to its movable arrangement susceptible to effect a movement having a vertical component with respect to the surface of the semi-finished product, the nozzle device is automatically guided by the control means to follow an unevenness of the strip or a bulging at the leading end of the strip while maintaining a pre-defined small target distance to said surface. With constant spray pressure existing at the nozzle outlet, the spray pressure at the work piece is increased thereby. The water pressure in the nozzle or the amount of water can thus be reduced when applying the invention, which at the same time leads to a reduction of the cooling in particular if the semi-finished products have small thickness (thin slabs).

In practical application, the distance can be reduced to 20 to 40 mm, i.e. to a tenth compared to a distance of the nozzle device in a region of 250 mm in the known apparatus. This leads to quite significant advantages with regard to the quality of descaling as well as with regard to the reduction of the water and power consumption and avoids unnecessary cooling down of the semi-finished product.

It is preferred if the nozzle device itself is designed as described in U.S. Pat. No. 5,502,881.

It is also preferred if besides the nozzle device also a scale discharge device is guided to follow the bulgings or unevenness of the semi-finished product in the same manner. For this purpose the scale discharge device may be provided above the strip surface movably with a component of movement vertical to the surface of the strip passed underneath in the same manner as the nozzle device.

It is also a feature of the present invention that the nozzle device has a plurality of rotor heads having rotating nozzles disposed in an array extending transversely to the moving direction of the semifinished product.

Another feature of this invention is that the nozzle device comprises a plurality of fixed or oscillatingly mounted nozzles that are provided in an arrangement supported by a bar and extend transversely to the moving direction of the semi-finished product.

Yet another feature of this invention is that a scale discharge device is mounted to a fixed carrier by means of a further linkage means and is vertically movable by a further lift cylinder also controlled by the control device in synchronism with the nozzle device.

The invention will now be further elucidated in more detail with reference to the drawing.

BRIEF DESCRIPTION OF THE DRAWINGS

The single FIGURE shows an apparatus according to the invention in a schematic side view, taken in a direction transversely to the direction of movement of the strip to be descaled.

DETAILED DESCRIPTION

A strip-shaped thin slab 4 is conveyed in the direction of movement as shown by the arrow 6 on a roller table 2. The slab 4 has a bulging 8 that may extend over a part of or over the entire width of the slab 4.

A nozzle device, which is generally designated by reference numeral 10, is disposed above the slab 4 and at a distance "a". The nozzle device 10 comprises a plurality of nozzle heads 12 disposed in an array transversely to the direction of movement 6, said nozzle heads each being equipped with four nozzles equally spaced over the circumference for spraying highly pressurized water. Only one nozzle head 12 can be seen in the drawing. The total arrangement is more clearly described in U.S. Pat. No. 5,502,881. Whereas there the nozzle heads are fitted to a bar disposed rigidly above the roller table 2, according to the present invention the nozzle heads are fitted to a bar 16, which is vertically movably mounted to be raised and lowered in the direction of the arrow 21 to a fixed beam 23 by means of a parallel linkage having links 18, 20. A hydraulic cylinder 22 engages the upper link 20 of the parallel linkage means.

A scale discharge device generally designated by reference numeral 24 is shown at 24. This scale discharge device has a collector housing 26 for scale glancing off from the slab surface having a baffle 28 by which the scale mixed with the highly pressurized water is directed to a discharge duct 30. The housing 26 is mounted to a vertical bar 32. This bar 32 is mounted through a parallel linkage having links 34, 36 to the carrier 23. The lower link 34 is acted upon by a hydraulic cylinder 38.

A distance sensor 40 is provided at the front end of the scale discharge device. This distance sensor detects the vertical distance "a" between the nozzle device 10 and the scale discharge device 24, respectively, and the surface of the metal strip. The distance sensor may be a mechanical, optical or electrical transducer, and converts the detected spacing into an electrical signal which is supplied via a signal line 42 to a control means 44. This control means is adjustable to a desired target distance "a" at 46. The control means 44 compares the measured actual distance with the pre-set target distance and supplies actuator signals for reducing the detected deviation to zero, said signals being supplied via signal lines 48, 49 to the cylinders 22, 38 to influence these cylinders for raising or lowering the bars 16 and 32, respectively. In this manner, the nozzle device 10 and the scale discharge device 24 are always kept at a desired distance from the surface of the slab 4 even if the slab has a bulging 8.

In practical application, a target distance "a" is preferably in the region of 20 to 40 mm.

In case of great widths of the slabs or strips, the bulgings or unevenness 8 are often not distributed evenly over the entire width of the slab or strip. In order to avoid that in case of a local bulging or hump the entire nozzle device along with the scale discharge device is raised, devices consisting of a plurality of independent sections, composed of the bars 16, 24 with the parallel linkage means and cylinders can be provided.

All components described above and including couplings, hoses and electric lines can be accommodated in a common housing 50. Parts subject to wear, such as the skids 52 of the scale discharge device 24 and deflecting baffles 54, 56, are replaceable.

The apparatus of the invention can be removed from the roller table 2 by means of lifting tools, such as a crane. Thus, maintenance and control works as well as tests can be performed remote from the roller table, e.g. in a workshop.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. An apparatus for descaling semi-finished products (4) by means of highly pressurized water that is sprayed through a nozzle device (10) onto the surface of the semi-finished product which is moved in a direction of movement past the nozzle device (10), wherein the nozzle device is arranged for movement towards and away from the direction of movement by a drive (22) under the control of a control device (44) comprising a sensor adapted to determine the distance (a) of the nozzle device from the surface of the product, the apparatus characterized in that a plurality of nozzle devices (10) attached at a bar (16) which is mounted at a fixed carrier (23) by means of a four bar linkage means (18, 20), which is pivotable by the drive (22), and in that the control device (44) is provided for actuating the drive (22) in response to an output signal of the sensor, which is designed as a displacement transducer (40), for keeping constant the distance (a) of the nozzle device (10) from the surface of the semifinished product.

2. The apparatus as set forth in claim 1, characterized in that the nozzle device (10) comprises a plurality of rotor heads (12) having rotating nozzles (14) disposed in an array extending transversely to the moving direction of the semifinished product (4).

3. The apparatus as set forth in claim 1, characterized in that the nozzle device comprises a plurality of fixed or oscillatingly mounted nozzles, that are provided in an arrangement supported by the bar (16) and extend transversely to the moving direction of the semi-finished product.

4. The apparatus as set forth in claim 1, characterized in that a scale discharge device (24) is mounted at the fixed carrier (23) by means of a further linkage means (34, 36) and is vertically movable by a further lift cylinder (38) also controlled by the control device (44) in synchronism with the nozzle device (10).

* * * * *